United States Patent [19]

Genovese

[11] Patent Number: 4,750,712

[45] Date of Patent: Jun. 14, 1988

[54] VEHICLE LIFTING DEVICE

[76] Inventor: Jolanda Genovese, Via Mazzini, 7, 30035 Ballo' Di Mirano Venezia, Italy

[21] Appl. No.: 870,896

[22] Filed: Jun. 5, 1986

[51] Int. Cl.[4] ..... B66F 3/22

[52] U.S. Cl. ..... 254/122; 254/124

[58] Field of Search ..... 254/124, 122, DIG. 4, 254/10 C; 269/171.5, 210, 68; 187/8.71, 8.72

[56] References Cited

U.S. PATENT DOCUMENTS

| | | | |
|---|---|---|---|
| 4,447,042 | 5/1984 | Masui | 254/124 |
| 4,460,158 | 6/1984 | Chiesa et al. | 254/124 |
| 4,475,373 | 10/1984 | Ikenberry | 254/124 |

*Primary Examiner*—Frederick R. Schmidt
*Assistant Examiner*—Judy J. Hartman
*Attorney, Agent, or Firm*—Charles W. Fallow; Martin P. Hoffman; Mitchell B. Wasson

[57] ABSTRACT

A lifting device comprises a fixed lower frame, an upper frame vertically movable with respect to the fixed frame and provided with members supporting the desired portions of the vehicle to be raised, articulated rods systems connecting the lower and upper frames, a mechanical energy generator placed between the articulated rods systems and acting on these so that to cause the raising of the movable frame with respect to the fixed frame, and a torsion bar connected to the fixed frame and acting on the movable frame in order to ensure its precise lifting.

2 Claims, 2 Drawing Sheets

VEHICLE LIFTING DEVICE

The present invention relates to a lifting device, particularly for vehicles.

An aim of the invention is to provide a lifting device which can be advantageously mounted on a conventional lifting ramp in order to further raise a vehicle or a portion of a vehicle resting on the lifting ramp.

Another aim of the invention is to provide a lifting device which can easily reach any portion of the vehicle without requiring that this vehicle moves with respect to the lifting ramp on which it rests.

Another aim of the invention is to provide a lifting device having a compact manufacture, a precise and reliable operating and a simple maintenance.

All these aims are attained according to the invention by a lifting device, particularly for vehicles, characterized in that it comprises:

- a fixed lower frame,
- an upper frame vertically movable with respect to the fixed frame and provided with members supporting the desired portions of the vehicle to be raised,
- articulated rods systems connecting said lower and upper frames,
- a mechanical energy generator placed between said articulated rods systems and acting on these so that to cause the raising of the movable frame with respect to the fixed frame, and
- a torsion bar connected to the fixed frame and acting on the movable frame to ensure its correct raising.

Figure 1:
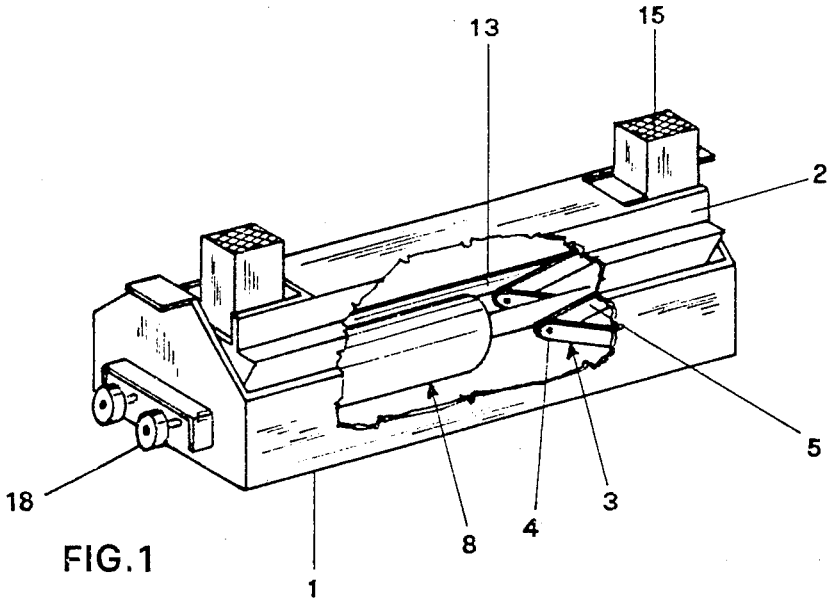
Figure 2:
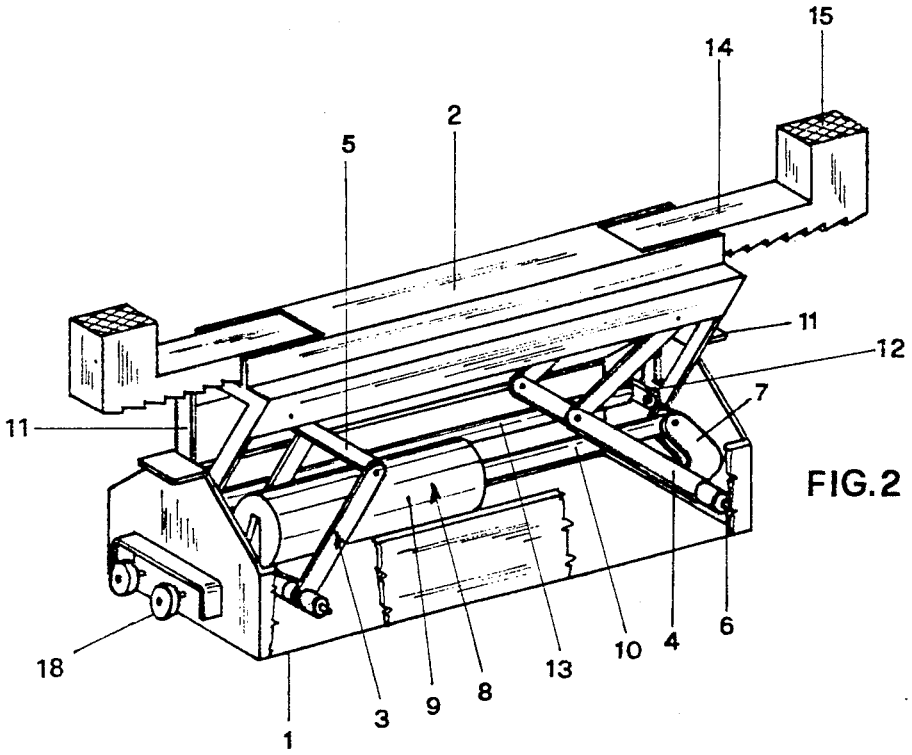
Figure 3:
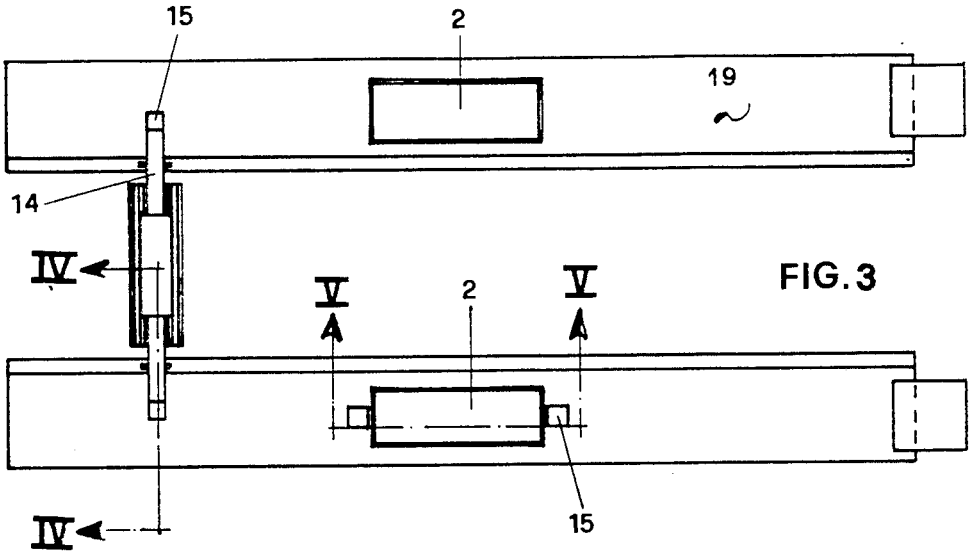
Figure 4:
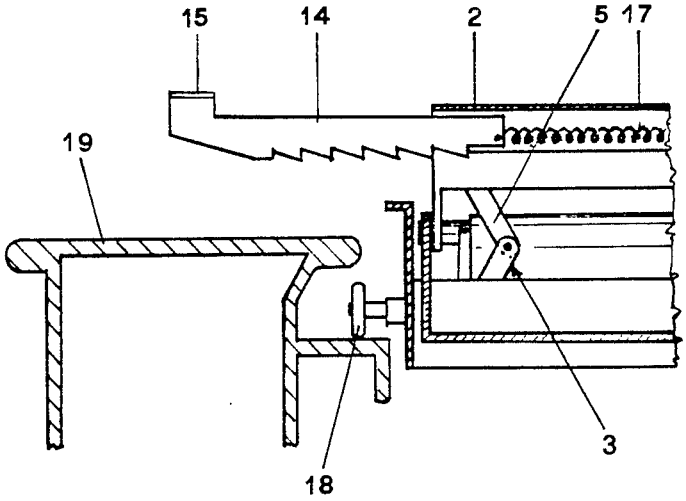
Figure 5:
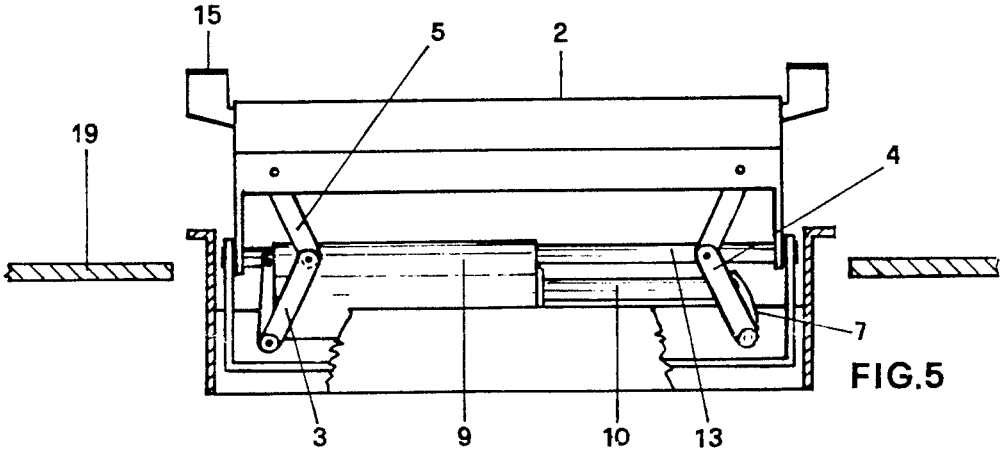

The present invention is hereinafter further clarified with reference to the enclosed drawings in which:

FIG. 1 shows in partly fragmented perspective view a lifting device according to the invention, in lowered condition, FIG. 2 shows it in the same view as FIG. 1 in raised condition and with the brackets partly extracted, FIG. 3 shows in plan view a lifting ramp for vehicles having, merely for example, three lifting devices according to the invention, FIG. 4 is a cross view therethrought on the line IV—IV of FIG. 2, and FIG. 5 is a longitudinal view therethrought on the line V—V of FIG. 3.

As can be seen in the drawings the lifting device according to the invention substantially comprises two metal frames, a lower fixed frame 1 and an upper frame 2, vertically movable with the respect to the fixed one. The two frames 1 and 2 are connected to each other by four articulated rods systems 3, placed in pairs at the two ends of each frame 1 and 2.

Particularly each system 3 consists of two rods, a lower rod 4 articulated to the lower frame 1 and an upper one 5 articulated to the upper frame 2 and to the respective lower rod 4. The lower rods 4 of the two systems 3 placed at each end of the frame 1 are furthermore connected to each other by shafts 6, and to each shaft 6 an arm 7 is bound. Between the two arms 7 an hydraulic jack 8 is placed, entirely housed inside the fixed frame 1: particularly the outside ends of the cylinder body 9 and the jack rod 10 of the jack 8 are articulated to the respective arm 7.

The upper frame 2 is constructed from a box-shaped plate and lowerly protrudes towards the lower frame 1 with two appendices 11, to which two arms 12 are pivotally connected bound to a torsion bar 13 housed inside the frame 1 parallel to the axis of the jack 8.

The upper frame 2 is hollow and internally houses a pair of metal brackets 14, provided at the outside end with blocks 15 on which the vehicle rests. The upper surface of each bracket 14 is perfectly flat whereas the lower surface is toothed for the engagement with respective edges provided at the ends of the frame 2.

Furthermore the two brackets 14 are connected to each other by a spring 17, also housed inside the frame 2 and operating so as to draw keep the brackets 14 toward to each other when no external stresses are applied.

The operating of the device according to the invention is as follows: when the jack 8 is not pressurized, the jack rod 10 is in its minimum elongation condition, the four systems 3 of articulated rods are in a folded condition, the upper frame 2 is near to the lower frame 1 and the device has a compact shape.

To carry out the raising of the frame 2 it is necessary to feed pressure oil inside the jack 8. In this case the jack rod 10 extends, and the elongation of the jack 8 causes the forced spreading of the ends of the two arms 7, thereby resulting in rotation of the four systems 3 of articulated rods, causing the raising of the upper frame 2. Due to the torsion bar 13, the axis of the jack 8 is kept, during the elongation of said jack 8, always parallel and therefore the raising of the upper frame 2 occurs with purely translative displacement.

When the movable frame 2 has been enough raised and when required by the particular conditions, the two brackets 14 can be manually drawn out from the same frame, to put the blocks 14 exactly under the portions of the vehicle to be raised, and rising occurs very regularly, independently from any unbalanced loading. Obviously the extraction of each bracket 14 occurs for elastic yielding of the spring 17, and the extracted condition of each bracket 14 is maintained due to the engagement of its toothed surface with the corresponding edge 16. It is simple enough to raise the brackets 14 to cause their disengagement and to enable the spring 17 to bring back them inside the frame 2. In particular this raising is advantageously obtained during the lowering phase of the frame 2, due to the impact of said brackets against the upper edge of the side wall of the frame 1.

The above described lifting device has an advantageous use in lifting ramps for vehicles. In a preferred embodiment, schematically shown in FIG. 4, to the fixed frame 1 ball bearings of pair of rollers 18 are applied showing the displacement of the device along the guide rail 19 of the lifting ramp and also allowing the further raising of the vehicle mounted on these. Obviously the opportunity to displace the device along the lifting ramp as well as of drawing out each bracket 14 from the upper frame 2, allows the blocks 15 substantially to reach any portion of the vehicle.

Also it may be noted that in this embodiment the raising of each bracket 14, which is necessary to disengage its toothed surface from the respective edge 16, automatically occurs during the lowering phase of the upper frame 2, due to the push caused firstly by the respective guide 19 and subsequently by the respective side wall of the frame 1.

In a further advantageous embodiment, schematically shown in FIG. 5, the device according to the invention is entirely housed inside each guide 19, having a rectangular cut out. In this case the brackets 14 are absent, or if they are present, they can be provided with removable blocks. To the upper frame 2 a plate (not shown) is soldered, which is coplanar to the guide 19, when the upper frame 2 is wholly lowered. As the sizes of said plate are scarcely lesser than the sizes of the cut out of the respective guide 19, when the upper 2 is lowered, said guide 19 is like a traditional guide.

I claim:

1. A lifting device for mounting on a vehicle lift comprising:

a lower frame, an upper frame vertically movable with respect to the lower frame, said upper frame having a pair of members for supporting a vehicle on the lift, two linkage systems connecting said upper frame to said lower frame, each of said systems comprising two pairs of rods of equal length, said pairs of rods being pivotally connected to said upper and lower frames respectively and being pivotally connected to one another in such a way that the pivotally interconnected rod ends of each system are closest to that of the other system when the upper frame is in its lowermost position, a pair of shafts, each journalled in the lower frame and each being affixed to the lower pair of rods in their respective linkage systems, an arm affixed to each shaft for rotating the same and thereby extending the linkage, a linear motor interposed between said arms in such a way that extension of said motor results in extension of said linkages, and a torsion bar mounted in said lower frame, said torsion bar having its axis orthogonal to said shafts and having connected at its ends a pair of arms pivotally connected to said upper frame to cause said linkages to extend equally when actuated by said motor, a pair of brackets supported within said upper frame in such a way that the brackets can be drawn axially out of the frame in opposite directions, resilient means for retracting said brackets into said upper frame, wherein said resilient means comprise a tension spring and wherein said brackets have toothed surfaces for engagement with an edge provided on said upper frame.

2. A lifting device for vehicles comprising a fixed lower frame an upper frame vertically movable with respect to the fixed frame and having a pair of extensible members for supporting desired portions of a vehicle, a pair of articulated linkages connecting said lower and upper frames, a mechanical energy generator disposed between said articulated linkage systems for causing extension thereof to raise the upper frame with respect to the lower frame, a torsion bar mounted within the fixed frame for maintaining parallelism between the upper and lower frames, wherein the upper frame is formed from a metal box-shaped plate bounding a space housing the two brackets and wherein the brackets can be axially drawn out of the upper frame in opposite directions and further comprising a tension spring tending to withdraw the brackets into the upper frame, each of said brackets having a toothed surface for engagement with a respective edge provided on the upper frame to hold the brackets in their extended positions as long as they support a load.

* * * * *